United States Patent [19]

Urbye et al.

[11] Patent Number: 4,552,623

[45] Date of Patent: Nov. 12, 1985

[54] COKE OVEN DOOR CLOSURE CONSTRUCTION

[75] Inventors: Klaus Urbye; Werner Abendroth, both of Haltern, Fed. Rep. of Germany

[73] Assignee: Firma Carl Still GmbH & Co., Kg., Fed. Rep. of Germany

[21] Appl. No.: 593,600

[22] Filed: Mar. 26, 1984

[30] Foreign Application Priority Data

Mar. 26, 1983 [DE] Fed. Rep. of Germany ..... 3311183

[51] Int. Cl.[4] ..... C10B 25/06

[52] U.S. Cl. ..... 202/248; 49/481; 110/173 R; 202/269

[58] Field of Search ..... 202/248, 268–270; 110/173 R; 49/481–483

[56] References Cited

U.S. PATENT DOCUMENTS

| | | | |
|---|---|---|---|
| 4,086,231 | 4/1978 | Ikio | 202/248 |
| 4,186,055 | 1/1980 | Baird et al. | 202/248 |
| 4,198,274 | 4/1980 | Ikio | 202/248 |
| 4,217,177 | 8/1980 | Gerding et al. | 202/248 |
| 4,226,679 | 10/1980 | Kelly et al. | 202/248 |
| 4,263,101 | 4/1981 | Thiersch et al. | 202/248 |
| 4,381,972 | 5/1983 | Stog | 202/248 |
| 4,400,240 | 8/1983 | Abendroth | 202/248 |

FOREIGN PATENT DOCUMENTS

| | | | |
|---|---|---|---|
| 23273 | 2/1981 | European Pat. Off. | 202/248 |
| 814897 | 9/1951 | Fed. Rep. of Germany | 202/248 |
| 864545 | 1/1953 | Fed. Rep. of Germany | 202/248 |
| 3105703 | 6/1982 | Fed. Rep. of Germany | 202/248 |
| 831202 | 10/1938 | France | 202/248 |

*Primary Examiner*—Jay H. Woo
*Assistant Examiner*—Joye L. Woodard
*Attorney, Agent, or Firm*—McGlew and Tuttle

[57] ABSTRACT

A coke oven door comprises a flat sealing diaphragm which is secured between and spaced apart from the door body and the door plug and is provided on its periphery with sealing knife edges which project against the door frame. The sealing edges are pressed against the door frame by bias adjustable springs, through spring loaded plungers. The door plug is formed by a plurality of individual plug elements closely adjacent to each other and supported by associated plug holders, and the sealing diaphragm is firmly screwed in place between the door body and the plug holders only in the upper and lower zones or areas of the door. In the intermediate zone, the diaphragm is connected to a back-up plate and to the plug holders and held adjustably spaced apart from the door body.

18 Claims, 4 Drawing Figures

COKE OVEN DOOR CLOSURE CONSTRUCTION

FIELD AND BACKGROUND OF THE INVENTION

This invention relates in general to the construction of coke ovens and in particular to a new and useful coke oven door closure for closing the opening within a coke oven frame which includes improved means for holding the sealing diaphragm in position.

A coke oven door is disclosed in German OS No. 30 44 703. According to that disclosure, one or two sealing diaphragms are firmly clamped between the door body and a continuous door plug holder, over the entire length of the coke oven door. To compensate for any unevenness of the sealing frame, the sealing diaphragms are pressed against the door frame by spring loaded plungers. This causes sharp bends in the diaphragms in the vicinity of the clamping locations or at provided weakening grooves. The more the diaphragms must be bent, the stronger are the springs that are needed and the stronger total forces must be taken up by the locking system of the coke oven door. In prior art doors of this kind, with firmly clamped sealing diaphragms, extreme bending of the diaphragm has frequently been observed, caused by the thermal deformation of the door body. The temperature differences within the door body frequently result in a deflection of the door body and diaphragm at locations both above and below an intermediate portion, from the door frame surface. These deflections must then be remedied by extreme ranges of spring action of the diaphragms. In the long run, such overloading may lead to leaks and material fatigue. Further, just above where the leveler door is provided, and at the foot stone in the zone of the firing hole, only little space is available so that the lever arms between the clamping location and the location where the sealing strip is applied to the diaphragm are very small.

Further known, from the German Utility model No. 79 13 785, is a coke oven door for high horizontal coke ovens, equipped with a sealing diaphragm and in which the door body carrying the refractory door plugs is assembled in the manner of a roller chain of two or more elements, with each element being pivotable about and below, about a horizontal hinge pin extending in the lontitudinal direction of the battery, and each hinge pin being supported by its ends on the lock hooks of the door frame. Such a door body is difficult to handle and needs many more locations where it must be locked to the door frame.

SUMMARY OF THE INVENTION

The invention is directed to a door having a rigid body, in which the sealing strip of the sealing diaphragm applies against the door frame, particularly in an upper area and in a lower area, without the necessity of substantially deforming the diaphragm, and a good sealing is obtained along the entire door frame between the sealing strip and the frame, due to substantially uniform contact pressures.

In accordance with the invention a door closure for closing and opening a coke oven frame comprises a door body which has a plurality of plug holders which carry, at the interior thereof, a separate upper plug holder and a separate lower plug holder along with one or more intermediate plug holders. Each plug holder carries a door plug and a sealing diaphragm which is arranged between the door body and the plug holders.

The sealing body includes a marginal portion which extends beyond the plug bodies and terminates in a sealing edge which is held in biased engagement with the door frame by adjustable spring elements.

In accordance with the invention, a back-up plate is disposed between the diaphragm and the door body and overlies the diaphragm. The plate is supported by adjustable means carried by the door body and connected to the plate to vary the position of the plate relative to the door body, the diaphragm and the intermediate plug holder or holders. The arrangement permits the positioning of the plug holders in adjustable position relative to the door body.

A particular feature of the invention utilizes the plug holders connected to the door body only at upper and lower areas of the door where, therefore, the sealing diaphragm remains almost stress-free under normal conditions of pressing the sealing strip against the door frame. Thus, the design of the door frame is such that under operating conditions and under a thermal deformation of the door body, the sealing strip of the diaphragm presses against the door frame in the upper and lower zones without a substantial deformation of the diaphragm. In the middle zone of the door, the spacing of the diaphragm and the door body can subsequently be adjusted, in accordance with the invention, by moving the back-up plates to which the sealing diaphragms are screwed, and the plug holders, by means of threaded spindles, toward or away from the door frame, in the longitudinal direction of the oven. This compensates for the other deformations of the door body and the door frame. Due to this subsequent adjustment in the middle zone of the door, the sealing diaphragm undergoes, over the entire height of the door, only slight deformations. It is never strained beyond the limit of elasticity and thus has a long life. The spring forces acting on the plungers become fully effective along the entire circumference of the door frame, so that the pressure of the spring-loaded plungers can be brought into relation with the total force to be taken up by the main locking system.

In accordance with a feature of the invention the sealing diaphragm is clamped between the back-up plate and the plug holders which are disposed in an intermediate zone of the door body with soft seals arranged therebetween. The soft seal provides an arrangement in which it is possible to make an extension of the diaphragm from one side to the other with only a penetration of the securing screws and this ensures a prevention of leaking.

The lower plug holder is firmly screwed to the door body around the firing hole which is provided at the lower portion of the door body and is designed with a flange. Then, advantageously the diaphragm which is clamped therebetween, is no longer screwed to the outer edge of the door body and a substantially longer lever arm is obtained between the location of the diaphragm clamping spot and the contact point of the sealing edge on the door frame. The upper door plug element may also be screwed to the door body around the flange level or door opening. This again displaces the location where the diaphragm is clamped inwardly so that the lever arm for the diaphragm is correspondingly extended.

In order to compensate for any distortion which might occur to the door body and the door frame, the distance between the door body and the back-up plate is adjustable through one or more spindles, eccentrics or wedges which are provided centrally or laterally on the door body. These adjusting means are secured to the door body in a manner so as to be easily accessible from the outside even with the door locked in place. Advantageously about one spindle per door plug holder may be provided. With a central arrangement of the spindle door plug holder the spacing between the door body and the back-up plate can be adjusted for each individual door portion separately as needed.

A particularly advantageous arrangement ensures that the distance between the door body and the back-up plate is adjustable between 8 and 50 millimeters and preferably at least from 35 to 40 millimeters. This is not an inconsiderable clearing between the door body and the back-up plate and it allows air circulation along the entire door body so that the thermal deformation is reduced and adjustment of the back-up plate and the diaphragm is preserved. Additional ventilation windows may further help circulation at the back of the door body.

In order to prevent the sealing diaphragm from being unduly deformed while putting the door in place, a door stop adjustable in the direction of the door body is provided laterally on the door body only in the upper and lower zones where the diaphragm is tightly biased against the door frame.

On a side exposed to the coal, the transition from one door plug element to the other is stepped. This prevents fine coal from penetrating into the entire gap between the door plug elements and obstructing the mutual movement of the elements.

The door plug elements are designed preferably as hollow plugs. As a rule, prior art hollow plug doors are formed by a plurality of closely spaced plug elements which, are individually firmly screwed to the door body. With the inventive arrangement hollow plugs are advisable particularly because of their substantially low weight and because they require back-up plates of smaller dimensions as well as adjusting spindles of smaller size.

A vertical gas escape chamber is advantageously formed between the door plug elements made of refractory stones and the door plug holders made of iron material. The chamber extends over the entire width of the door plug and communicates with the oven chamber through slots which are provided at stepped levels in the side arms of the door plug holders and through lower and upper apertures.

This is somewhat a combination of solid and hollow plug elements with no change required in the side which is contacted by the coal, and the desired gas escape chamber is provided at the door body side. This inventive space between the back-up plates and the door body reduces the temperature to which the door body is exposed and therefore expensive special thermal insulation for the door body may be omitted.

The ratio of the thickness of the door plug elements to the clearance in the same direction of a gas escape chamber is 0.5 to 1 at most. It is preferably 3 to 1. Within these ranges a satisfactory life of the refractory stones as well as a satisfactory cross-sectional area for the gas escape are ensured. The low temperature of door body now makes it possible to manufacture the entire door body as a welded structure, in accordance with the invention. Expensive casting can be avoided.

The invention provides in addition that the door frame is welded to an armor plate around its entire periphery. It is assumed of course that the door frame and, at least partly, the armor plates are made of steel. A continuous weld provides a complete seal between the door frame and the armor plates. It may also be provided, however, that the door frame is secured to an armor plate by brackets and springs. This may compensate for small deformations of the door frame relative to the armor plates, without requiring additional forces exerted by an anchoring system. One or more cup springs may compensate for displacements of the door frame relative to the armor plate which may even be taken up by soft seals. To obtain a high surface pressure of the chamber frame on the refractory stones under the same outer pressure, the chamber frame may be provided on the side of the refractory stones with at least one sealing strip protruding inwardly, i.e. toward the refractory masonry. With the same thickness of the soft seal there also inserted, a considerably higher surface pressure is obtained at the sealing strip.

Accordingly it is an object of the invention to provide an improved closure construction for a coke oven door frame which includes an intermediate section of a door body which carries a backing plate which is positioned behind a diaphragm and secured to a plug holder and which is mounted in respect to the door body for adjustable movement.

A further object of the invention is to provide a door closure for a coke oven which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
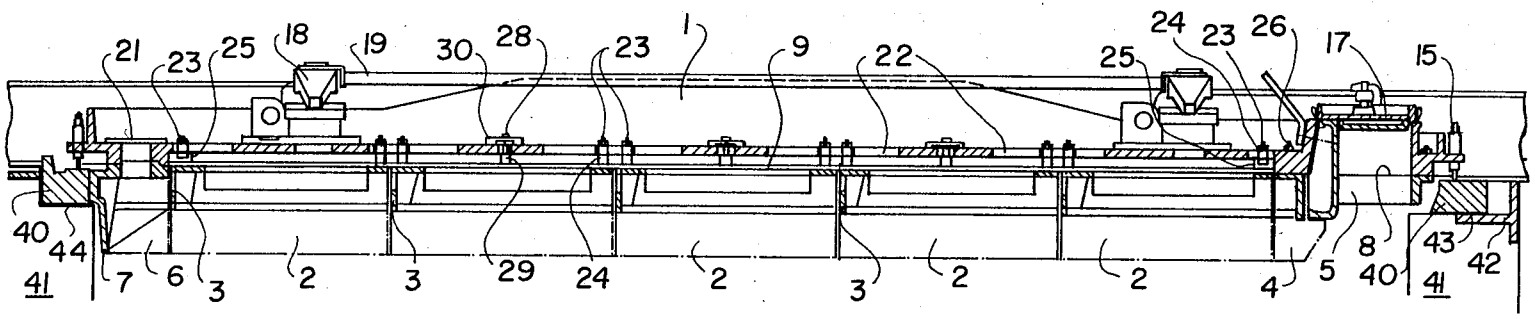
FIG. 1 is a longitudinal sectional view of an inventive coke oven door.

Referring to the drawings in particular the invention embodied therein comprises a door closure for closing and opening of a coke oven frame or door frame 40 and which comprises a door body 1 which has a plurality of plug holders including a separate upper plug holder 5 for a plug 4 and a separate lower plug holder 7 for a plug 6. In addition an intermediate area of the door body carries at least one intermediate plug holder 3 for one or more plugs 2.

In accordance with the invention, an intermediate area and the upper and lower areas all include a sealing diaphragm 8 which is arranged between the door body 1 and the plug holders. The sealing diaphragm 8 has a marginal area adjacent its periphery which extends beyond plug holder 3,5 and 7 and terminates in a sealing edge 12 around its periphery which bears against the frame in sealing engagement therewith. Biasing means in the form of a spring stack 15 may be adjustably tensioned to bias the sealing edge 12 into sealing engagement with the door frame 40 around the periphery thereof. Frame 40 is defined over refractory masonry 41.

In accordance with a feature of the invention, a back-up plate 9 is engaged over the diaphragm 8 and disposed between the diaphragm and the door body 1. Plate 9 is adjustabley positionable with respect to the door body by adjustment means in the form of a securing screw or spindle 28 which is threaded into a bushing 29 which is secured to the back-up plate 9. The securing screw 28 is held in a latch plate 30 which is carried by door body 1.

Figure 2:
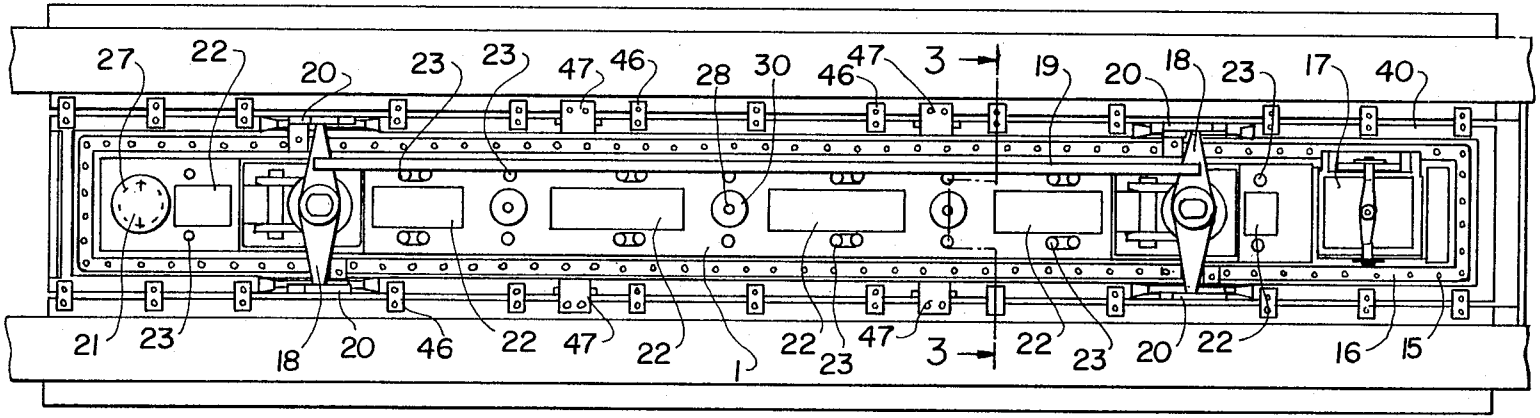
FIG. 2 is a rear view of the coke oven door.

FIGS. 1 and 2 show particularly the arrangement of the individual door plug elements 2, 4 and 6 and of the plug holders 3,5 and 7 and door body 1. The sealing diaphragm 8 and back-up plate 9 are firmly connected to the plug holders 3 or plug elements 2 by screws 23 and spacer tubes 24. As may be learned primarily from FIG. 3, necked-down screws 23 with the spacer tubes 24 are guided in recesses of the door body, so that during the adjustment of spacing between the back-up plate and the door body, through spindles 28, they can move in the direction of adjustment. The associated threading bushing 29 of spindle 28 is firmly connected through a latch plate 30 to door body 1. In upper and lower areas or zones of the door, the door body and the sealing diaphragm are firmly screwed to the associated door plug holders 5 or 7, by securing screws 26. In these zones, the back-up plate 9 may be omitted. In the transition portion from the firmly clamped part to the movable part, each of the necked down screws 23 is provided with the additional spacer tube 24, to hold the back-up plate and the diaphragm firmly in place before the extension of the central movable part. An intermediate piece 25 may be also be provided between plate 9 and screws 23 as shown in FIG. 1.

Reference numbers 10 to 22, 40 to 45 and 40 to 51 are generally known structural elements.

Figure 3:
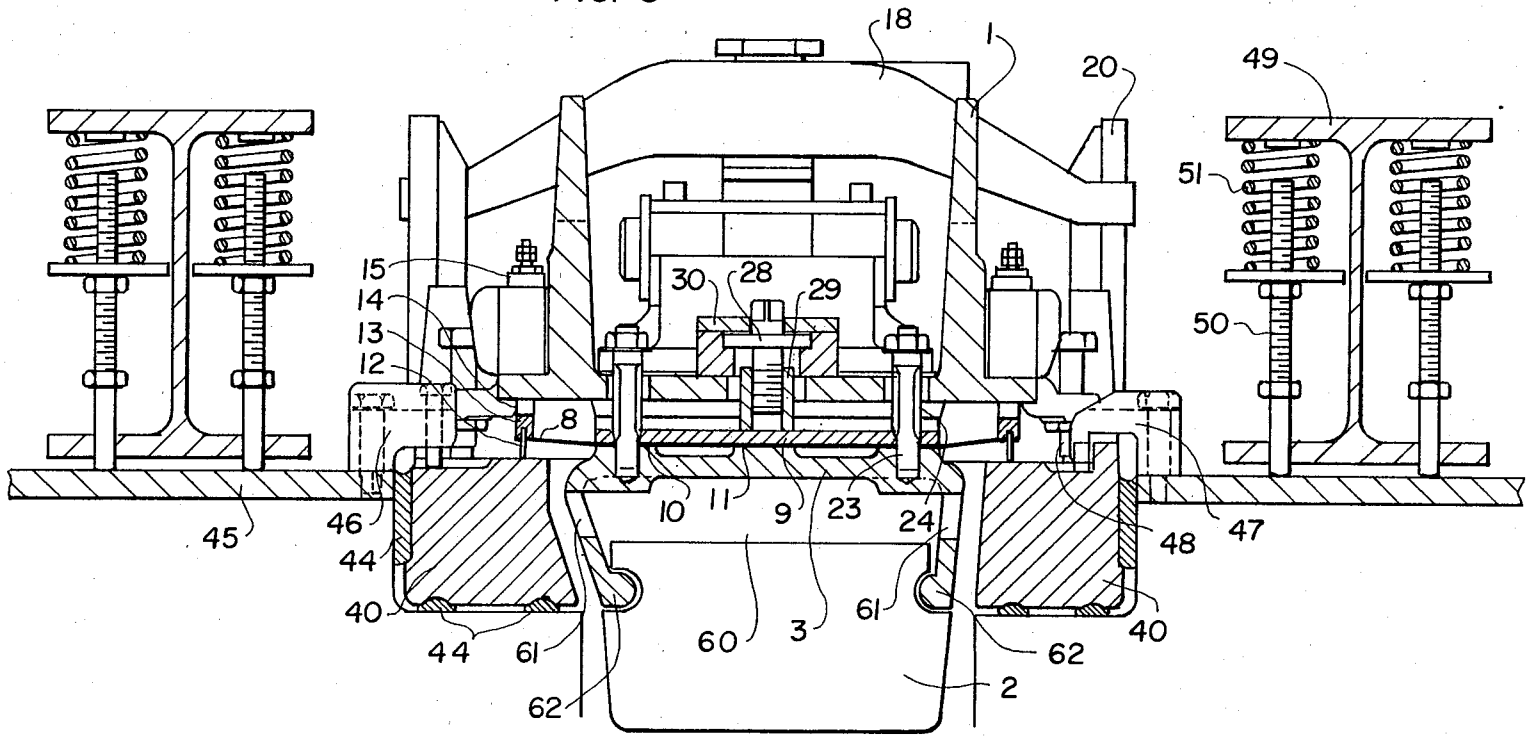
FIG. 3 is an enlarged cross-sectional view of the coke oven door taken along line 3—3 of FIG. 2.

Sealing edge 12 is held in a sealing edge holder 13 which is biased against the door frame 40 by spring loaded plungers 14. The biasing force on the plungers 14 is adjusted by spring stacks 15. The door body 1 carries a peripheral door body flange with tap holes and exchangeable plunger tubes. The door body 1 also carries a locking mechanism 18 with spindle and latch bar. A locking linkage 19 is connected to the locking mechanism 18 which locks onto locking hooks 20 on the door frame 40. The door body also includes ventilation apertures 22. Door frame 40 is held on masonry 41 by a supporting section 42 carrying a seal 43 which is provided between the door frame and the supporting section. As shown in FIG. 3, seals 44 are provided between the door frame 40 and the refractory masonry. Anchor posts 49 are provided laterally outwardly of the door body 1 and these support spring-loaded plungers 50 which are biased downwardly by compresion springs 51.

FIG. 3 shows at 46 and 47, the possibilities of connecting armor plates 45 to frame 40. At 46 a so-called thrust bracket is shown which is firmly screwed to the armor plate on one side and holds on the other side the door frame by means of a set screw. At 47, a so-called necked down bracket is shown which is firmly screwed to the armor plate on one side and engages on the other side an extension of the door frame, to prevent the door frame from becoming displaced toward the door (i.e. in the longitudinal direction of the oven).

At 48, a door stop is indicated which is provided only in the upper and lower zones and serves as a stop as the door is put in place in the coke oven opening.

FIG. 3 further shows the vertical gas escape chamber 60 which is formed on one side by door plug elements 2,4,6 and on the other three sides by door plug holders 3,5, and 7. The level slots 61 are provided in the side arms 62 of door plug holders 3,5 and 7. The size of the gas escape chamber 60 is determined by the distance between the outer portions of the door plug holders and the door plug elements. This size can be enlarged as far as permitted by the side arms 62 of the door plug holders.

Figure 4:
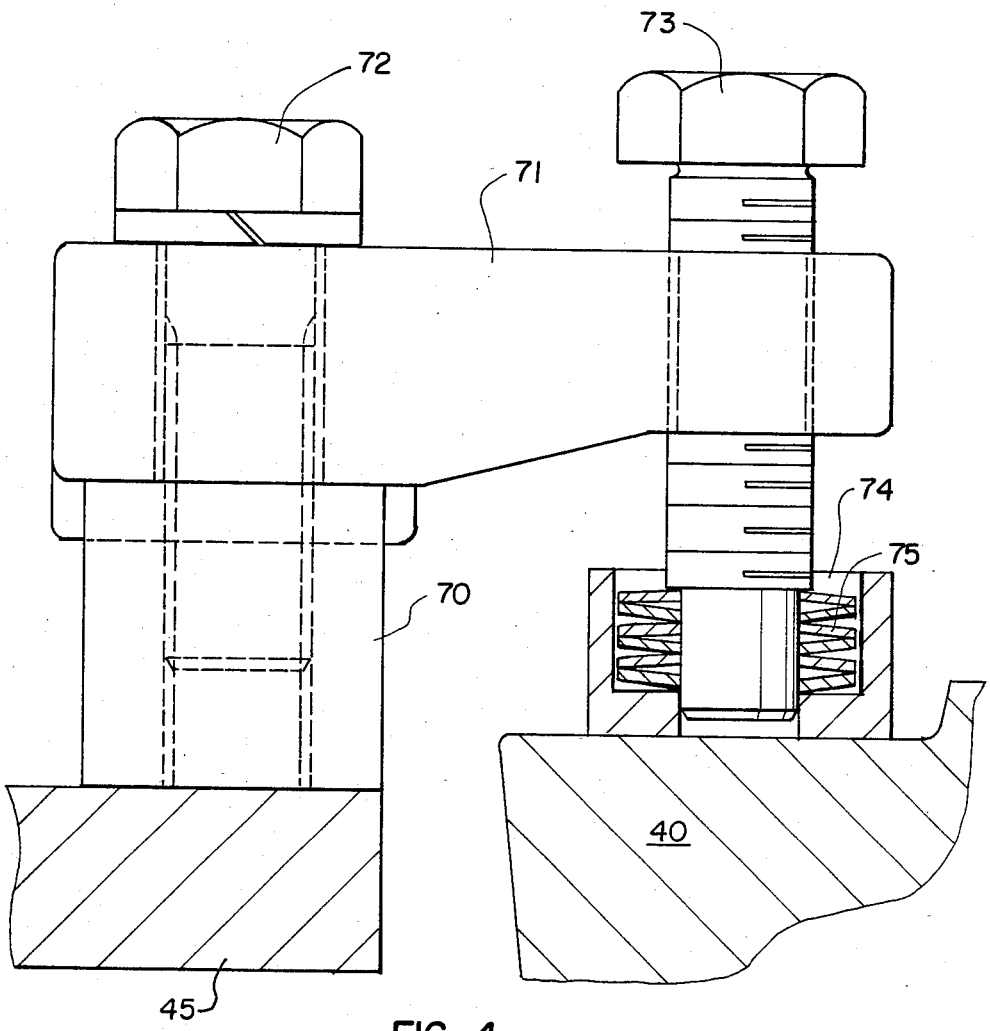
FIG. 4 is a detail showing the connection between a door frame and an armor plate.

FIG. 4 shows an embodiment of a thrust bracket 70 similar to bracket 46. The threaded bracket 70 is screwed to armor plate 45 and the securing screw 72 with a retainer 71 is screwed therein. On the free end of retainer 71, thrust screw 73 is screwed in a manner such that it exerts thrust through cross sleeve 74 on door frame 40 to hold it in place. A plurality of cup springs 75 is provided between thrust screw 73 and thrust sleeve 74, with the springs having a travel stroke of several millimeters.

In accordance with a feature of the invention, the sealing diaphragm 8 is clamped between the back-up plate 9 and plug holders 3 with the interposition of correspondingly thin soft seals 10 and 11. Lower plug holder 7 is firmly screwed to the door body 1 around a firing hole 27 which is covered by a cover plate 21. The firing hole is provided in the door body 1 and has a flange portion.

The upper plug element 5 is firmly secured to the door body 1 around a leveling door opening 17 which is also designed with a flange.

In order to compensate for a distortion of the door body 1 and the door frame 40 which might occur, the distance between the door body 1 and the back-up plate 9 is adjustable through one or more of the spindles 28 or similar adjustment means which are provided centrally or laterally on the door body. On the average, about one spindle 28 or similar element per plug holder 3 is provided on the door body. The distance between the door body and the back-up plate is adjustable between 0 and 50 millimeters, preferably from 35 to 40 millimeters.

In order to prevent the sealing diaphragm from being unduly deformed while putting the door in place, a door stop 48 is adjustable in the direction of the door frame and is provided laterally on the door body only in the upper and lower zones of firm clamping.

On a side of the door which is exposed to the heat of the coke oven, the transition from one door plug to the other is stepped so that no coal will lodge in the spaces therebetween. In all instances the plugs are advantageously hollow members.

The vertical gas escape chamber 60 is formed between the door plug elements 2,4 and 6 which are made of refractory stones. The door plug holders are made of iron material and the chamber 60 extends over the entire width of the door plug and communicates with the oven chamber through slots 61 which are provided at stepped levels in the side arms of the door plug holders and through lower and upper apertures.

The ratio of the thickness of the door plug elements to the clearance in the same direction of the gas escape chamber 60 is 0.5 to 1 at most and is preferably from 3 to 1.

The entire door body is a welded structure.

The door frame and the armor plates are connected to each other by a weld along the entire circumference of the door. The door frame is secured to the armor plates through clamping brackets or springs in some instances. A chamber frame is designed with at least one inwardly protruding sealing strip on a side of the refractory stones.

While specific embodiments of the invention have been shown and described in detail to illustrate the application of the principles of the invention, it will be understood that the invention may be embodied otherwise without departing from such principles.

What is claimed is:

1. A door closure for defining and closing an opening in a coke oven, comprising a door frame, a door body, a plurality of plug holders connected to plugs and carried by said door body including a separate upper and a separate lower plug holder arranged adjacent and fixedly mounted to the top and bottom respectively of the door body, and at least one movable intermediate plug holder between said upper and lower plug holders, a sealing diaphragm between said door body and said upper and lower intermediate plug holders and having a marginal portion extending beyond said plug holders and terminating in a sealing edge around its periphery bearing against the frame in a sealing engagement therewith, biasing means biasing said sealing edge into engagement with the frame, a movable back-up plate connected to said intermediate plug holder and a corresponding portion of the diaphragm and disposed between said diaphragm and said door body, and adjustable means connected to said door body and connected to said plate for varying the position of the plate and said intermediate plug holder and said corresponding portion of said diaphragm relative to said door body.

2. A door closure according to claim 1, wherein there are a plurality of intermediate plug holders, said adjustable means including a bushing secured to said plate and a threaded member carried by said door body and engaged in said bushing in threaded engagement and being rotatable to vary the position of said plate relative to said door body.

3. A door closure according to claim 1, wherein said biasing means includes a spring stack carried on said door body and an adjustment nut engaged in said spring stack for compressing said spring stack to vary the biasing force on said sealing edge.

4. A door closure according to claim 1, including an armor plate extending around said door frame, a bracket secured to said armor plate, a securing screw threadably engaged in said bracket, a retainer movable by said securing screw and engaged with a thrust screw at its outer ends, and a thrust screw threadably engaged with said retainer and being engaged at its opposite end with the door frame.

5. A coke oven door for closing an opening defined by a coke oven door frame, comprising a door body, a door plug assembly carried by the door body, a flat sealing diaphragm secured between and spaced apart from the door body and the door plug assembly, the diaphragm having an outer annular peripheral zone with sealing knife edges which are adapted to be pressed against the door frame, a plurality of adjustable spring assemblies with spring-loaded plungers carried by the door body and engaged against the peripheral zone of the diaphragm for pressing the sealing knife edges, the door plug assembly including a plurality of individual closely adjacent door plug elements each supported by an associated door plug holder, the door plug assembly including an upper and a lower plug holder each having a plug element and each fixedly mounted to the respective top and bottom of the door body, the diaphragm being fixedly connected between the upper and lower plug holders, the door plug assembly also including at least one intermediate plug holder with a plug element, a back-up plate connected to the intermediate plug holder and a corresponding portion of the diaphragm, adjustable means connected to the door body and connected to the back-up plate for varying the position of the back-up plate and the intermediate plug holder with the corresponding portion of the diaphragm relative to the door body.

6. A coke oven door according to claim 5, wherein the sealing diaphragm is clamped between the back-up plate and the plug holders with the interposition of correspondingly thin soft seals.

7. A coke oven door according to claim 5, wherein the lower plug holder is firmly screwed to the door body around a firing hole which is provided in the door body and designed with a flange.

8. A coke oven door accoring to claim 5, wherein the upper plug holder is firmly secured to the door body around a leveling door opening which is designed with a flange.

9. A coke oven door according to claim 8, wherein to compensate for a distortion of the door body, a distance between the door body and the back-up plate is adjustable through one or more spindles which are provided on the door body.

10. A coke oven door according to claim 9, wherein one spindle per plug holder is provided on the door body.

11. A coke oven door according to claim 10, wherein said spindles are arranged and constructed to adjust the distance between the door body and the back-up plate between 0 and 50 mm.

12. A coke oven door according to claim 11, wherein to prevent the sealing diaphragm from being unduly deformed while putting the door in place, a door stop adjustable in the direction of the door frame is provided laterally on the door body, only at the top and bottom thereof.

13. A coke oven door according to claim 12, wherein on a side exposed to coal, the transition from one door plug element to the other is stepped.

14. A coke oven door according to claim 13, wherein the door plug elements are designed as hollow plugs.

15. A coke oven door according to claim 14, wherein a vertical gas escape chamber is formed between the door plug elements made of refractory stones, and the door plug holders made of iron material, which chamber extends over the entire width of the door plug assembly and communicates with the oven chamber through slots which are provided at stepped levels in side arms of the door plug holders, and through lower and upper apertures.

16. A coke oven door according to claim 15, wherein the ratio of the thickness of the door plug elements to the clearance in the same direction of the gas ecape chamber is from 0.5 to 1 at most.

17. A coke oven door according to claim 16, wherein the entire door body is a welded structure.

18. A coke oven door according to claim 17, wherein the door frame and armor plates are connected to each other by a weld along the entire circumference of the door body.

* * * * *